US005921703A

United States Patent [19]

Becker et al.

[11] Patent Number: 5,921,703

[45] Date of Patent: Jul. 13, 1999

[54] CALTROP

[76] Inventors: Jonathan B. Becker, 132½ La Porte St., Arcadia, Calif. 91006; Martin L. Dala, 16742 Bayview Dr., Sunset Beach, Calif. 90742; Bryan R. Nix, 1165 Overlook Bridge Rd., Diamond Bar, Calif. 91765; Louis G. Trnovec, 338 Prospect Ave., Monrovia, Calif. 91016

[21] Appl. No.: 08/882,515

[22] Filed: Jun. 25, 1997

Related U.S. Application Data

[51] Int. Cl.[6] ..... E01F 13/02

[52] U.S. Cl. ..... 404/6; 256/1

[58] Field of Search ..... 404/6, 9; 256/1, 256/13.1

[56] References Cited

U.S. PATENT DOCUMENTS 1,094,226 4/1914 Le Duc ..... 256/1

2,313,388 3/1943 McDonald ..... 256/1

2,346,713 4/1944 Walker ..... 256/1

3,387,824 6/1968 Jonas et al. ..... 256/1

*Primary Examiner*—William Neuder

*Attorney, Agent, or Firm*—Gene W. Arant; Christopher R. Balzan

[57] ABSTRACT

A rigid caltrop structure is formed of two metallic members abutting each other and welded together, each of the members including all of a single triangular planar portion and parts of two other adjoining triangular planar portions, the pairs of adjacent corners of sides of the triangular portions forming penetration points so that when three of the penetration points rest on a horizontal surface and the fourth penetration point projects upward, a force applied to that fourth penetration point will not directly tend to shear the weld.

20 Claims, 4 Drawing Sheets

CALTROP

BACKGROUND OF THE INVENTION

The present invention relates to an improved version of a caltrop. The American Heritage Dictionary of the English Language, 3rd ed., 81992, Houghton Mifflin Co., herein incorporated by reference, defines a caltrop as: a metal device with four projecting spikes so arranged that when three of the spikes are on the ground, the fourth points upward, used as a hazard to pneumatic tires or to the hooves of horses.

Although the basic form and function of a caltrop are well known, modern improvements in such areas as tire composition and puncture resistance along with increased vehicle weights and required penetration forces necessitate improvements to the known prior art. In addition, specific requirements by military or law enforcement may further compel improvements or specialization of tire puncture devices.

For example, one prior art caltrop having two cylindrical metal bars bent and welded together to form four cylindrical metal spikes may puncture a tire and remain in it thereafter so that the spike actually plugs the hole and prevents deflation. Or, the tire may actually reseal the puncture thereby preventing deflation.

Prior attempts have been made to try to improve caltrop design but are not as effective or versatile as the current invention. For example, although other prior art caltrops, such as one designed by a National Laboratory made of two planar pieces of sheet metal joined along a seam formed by the axis of two of the spikes, may be better than the round spike type at preventing resealing of the puncture, it may become wedged in the tire and prevent rapid deflation. Additionally, empirical data show that in certain orientations, the tips of this type of caltrop bend over or the entire caltrop tends to fold like a "taco" rather than puncturing the tire.

The present invention was designed in response to military need for an effective, versatile, dependable, and cost effective tire deflation device. The design of the present invention is a significant improvement over the prior art in several respects. It has proven to be more reliable, effective, and versatile. In addition, the present invention can be manufactured cost effectively.

SUMMARY OF THE INVENTION

An object of the present invention is to provide a reliable device for disabling vehicles with pneumatic tires. Another object of the invention is to provide an improved caltrop that is stable while puncturing a pneumatic tire. Yet another object of the invention is to provide an easily manufactured improved caltrop that is capable of rapidly deflating a pneumatic tire.

In keeping with the objects of the invention the preferred embodiment of the invention has a rigid structure with four identical planar portions, each of a generally isosceles triangular configuration. Each of the short sides of each planar portion coincides with the short side of another planar portion. The apices of all the short sides of the planar portions are therefore joined in the center of the structure. The pairs of adjacent corners of the short sides form penetration points.

The structure thus defined is formed of two metallic members each of which comprises the entirety of a single triangular planar portion but only part of two other adjoining planar portions. The edges of the two metallic members abut each other and are welded together so that when any three of the penetration points rest on a horizontal surface and the fourth penetration point projects upward, a force applied normal to upward projecting point causes a shearing force along the weld.

The preferred embodiment may also have the long side of each planar portion of the structure cut away along an arcuate path that is recessed with respect to the long side of the triangle so that each penetration point upon penetrating a vehicle tire will readily cause air to flow out of the tire when the penetration is deep enough that the pair of arcuate surfaces enter the tire. Additionally, the preferred embodiment may provide barb shoulders defined by the arcuate cut always and formed substantially perpendicular to the axis of penetration to keep the embedded caltrop from exiting the tire.

DETAILED DESCRIPTION

As described below, the present invention contains several improvements which distinguish it from the prior art. The present invention was designed after observation and analysis of empirical performance data for the prior art, as well as prototypes, to develop a more reliable, versatile, effective, and cost efficient caltrop.

The Prior Art

(FIG. 1)

Figure 1:
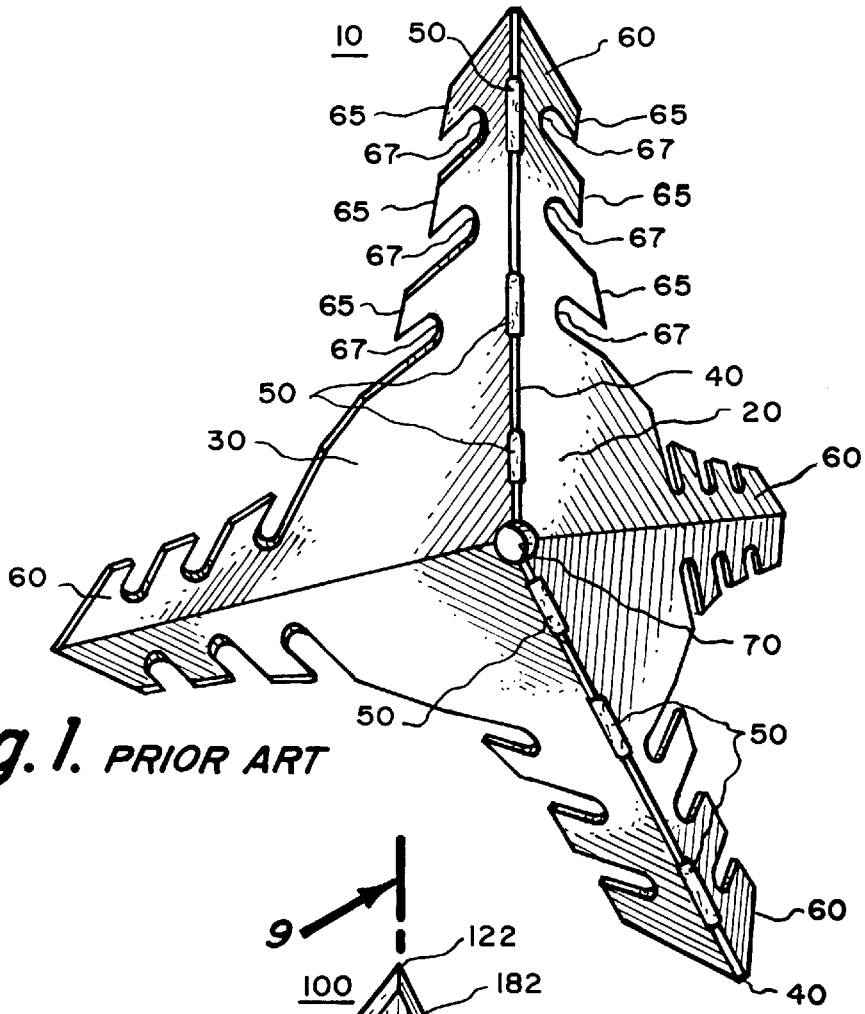
Fig. 1. PRIOR ART
FIG. 1 is an isometric view of the prior art.

FIG. 1 illustrates a prior art caltrop. The caltrop of FIG. 1, although designed at great expense in a National Laboratory, was found to have several shortcomings and is not as effective as the present invention in several respects. Due to its design, the prior art is not as sturdy and not as effective at rapidly releasing air. Furthermore, when strung together with additional caltrops, its design is not as effective in ensuring secondary damage to the tire or vehicle.

The prior art caltrop 10 consists of two planar pieces of sheet metal 20 & 30 joined by welds spots 50 along a seam 40 formed by the axis of two of the spikes 60. The prior art also features a stringing hole 70 through the center of the caltrop dividing the seam 40 in half. This design was shown empirically to weaken the caltrop and allow the caltrop to fold like a "taco" rather than penetrate the tire when a downward or a partially lateral force is applied to it. Although this does not occur under all conditions, limits on deployment orientation, vehicle weight, or tire type, limit the effectiveness or reliability of the prior art. The design of the prior art also limits reliability because in addition to folding along the seam 40, the vertical spike 60 sometimes folds over at the narrow span between opposing barb cut-outs 67 rather than penetrating the tire.

The design of the prior art is also less effective at rapidly releasing air from tires. The prior art has empirically shown to become wedged tightly in the tire after penetration. As in the case of prior art caltrops made with round spikes, becoming tightly wedged in the tire tends to limit the amount of air that can escape through the puncture. Therefore, this is not an optimal design for rapid deflation.

Another drawback with the prior art is that its design limits the effectiveness of connected or attached caltrops to cause secondary damage to tires or vehicles. Caltrops are commonly strung together using, for example, wire. Attachment in this manner causes the caltrop that has penetrated and embedded itself in a tire to pull the remaining caltrops along thereby entangling the connected caltrops with the vehicle and causing further damage to the tire or vehicle. Such damage would necessitate more than a mere tire repair or replacement to continue down the road. The design of the prior art is not as effective in ensuring secondary damage by attached caltrops.

It is not as effective because, with the prior art, the spikes 60 have an ever increasing breadth or span. When the embedded caltrop is tugged by the attached caltrops, the ever increasing spike span causes the caltrop to be prone to simply be pulled out. Even with large barbs 65 defined by cut-outs 67, the design of the prior art 10 is not as effective at staying lodged in the tire when tugged by attached caltrops.

The Presently Preferred Embodiment

(FIG. 2)

Figure 2:
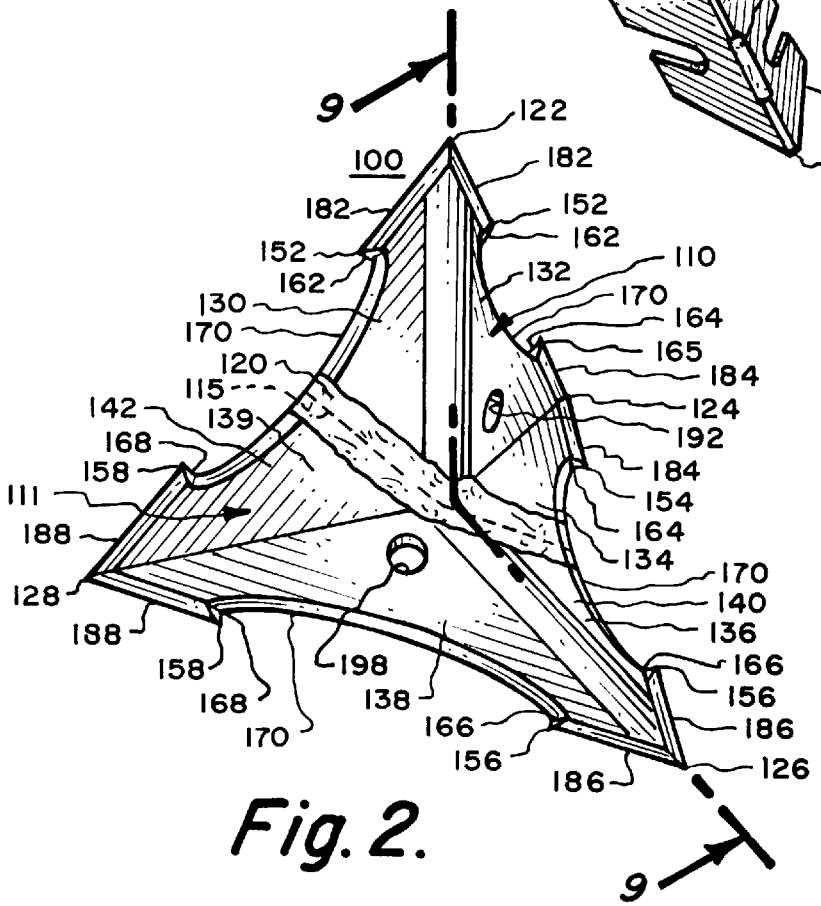
FIG. 2 is an isometric view of the presently preferred embodiment of the invention.

FIG. 2 shows the presently preferred embodiment of the invention. The presently preferred embodiment 100 is comprised of two attachable rigid members 110 & 111. Each of the rigid members 110 & 111, can have two integrally formed penetration tips 122 & 124 and 126 & 128 respectively. In the presently preferred embodiment, the rigid members or metallic members 110 & 111 are attached along a seam 115 by weld 120. Seam 115 approximately bisects each of the radial angles formed by the now adjacent tips 122 & 128 and 124 & 126 with the center of the caltrop. Although it is not necessary for seam 115 to bisect the radial angle formed by the now adjacent tips, approximately bisecting the angle ensures that when any of the penetration tips or points 122, 124, 126, or 128 projects upward, a force applied normal to or downward upon the upward projecting point causes a shearing force along the weld. This feature helps prevent the caltrop 100 from folding like a "taco".

It is presently preferred to form the weld continuously through the center of the caltrop, rather than having a stringing hole through the center as does the prior art shown in FIG. 1 as 70. This feature significantly improves the strength of the caltrop as the stringing hole in the center empirically was shown to weaken the caltrop and allow the caltrop to fold when stressed.

In the presently preferred embodiment of FIG. 2, each of the rigid members 110 & 111 have three planar portions. Rigid member 110 is formed of planar portions 130, 132 & 134. The first portion 132 is of generally isosceles triangular shape. In the presently preferred embodiment, the apex angle of the first portion is approximately 110 degrees with approximately 35 degrees defining each of the other angles of the first portion. The second planar portion 130 and the third planar portion 134, are of generally right triangular shape so that the hypotenuse of each of the second and third portions 130 & 134 is equal in length to the equal sides of the first portion 132. The hypotenuse of each of the second and third portions 130 & 134, is attached to the first portion 132 so that each abuts one of the equal length sides of the first portion 132.

Rigid member 111 is similarly formed having a generally isosceles triangular planar portion 138 and two generally right triangular portions 136 & 139 so that when the members 110 & 111 are attached, the structure formed has four equivalent planar portions 132, 140, 138, & 142 of generally isosceles triangular shape. The corners opposite the equal sides of the four planar portions each combine with adjacent corners to form the penetration tips 122, 124, 126 & 128. The penetration tips are generally V-shaped along the axis formed by each of the abutting four isosceles planar portions. In the presently preferred embodiment, the angle formed inside the "V" is approximately 120 degrees.

In the presently preferred embodiment of FIG. 2, each of the penetration tips 122, 124, 126 & 128 has two barbs 152, 154, 156 & 158 respectively. The barbs are defined by arcuate partial-pie-section cut-outs 170 in each of the four planar portions 132, 140, 138 & 142. The arcuate cut-outs 170 have a radius positioned external to the caltrop structure so that the radius does not pass through the caltrop structure. In other words, the arcuate cut-outs 170 curve away from the center of the structure.

A pair of barb shoulders 162, 164, 166 & 168 are provided on each of the tips 122, 124, 126 & 128. To create the barb shoulders 162, 164, 166 & 168, the end points of each arc of the arcuate cut-outs 170 are recessed from the base of each of the four planar members 132, 140, 138 & 142 so that each arcuate cut-out defines two barbs, each one on a different tip. It is preferred to form the shoulders 162, 164, 166 & 168, substantially perpendicular to the axis of penetration of each of the tips 122, 124, 126 & 128.

The substantially perpendicular barb shoulders 162, 164, 166 & 168 provide a means for the caltrop 100 to remain embedded after penetrating the tire. Unlike the prior art of FIG. 1, the barbs of the presently preferred embodiment of the invention are more likely to grip the inner wall of the tire rather than pull back through it when tugged by additional caltrops which are attached or strung to it. As such, smaller barbs can provide better caltrop retention.

Additionally, the presently preferred embodiment of FIG. 2 provides improved resistance against tip folding. With the prior art of FIG. 1, under certain conditions the vertical spike 60 sometimes folds over at one of the narrow portions between opposing barb cut-outs 67 rather than penetrating the tire. The design of the presently preferred embodiment of FIG. 2 uses smaller length barbs which increases the minimum span between the barbs thereby increasing resistance against tip folding.

Furthermore, unlike the prior art of FIG. 1 in which the barb structures 65 form spikes 60 having an ever increasing span, the structure defined by the cut-outs 170 is substantially narrower adjacent the barbs 152, 154, 156 & 158 and gradually increases in breadth or span further away from the point. This provides air escape outlets adjacent the barbs 152, 154, 156 & 158. The air escape outlets are best shown as 172 in FIG. 9. Although the air escape outlets of the present invention could be provided by elongated cut-outs internal to the four planar portions 132, 140, 138 & 142, it is presently preferred to form them with the recessed cut-outs 170 adjacent the barbs shoulders 162, 164, 166 & 168. The recessed cut-outs 170 form a gradually increasing span which allows for further initial tip penetration and allows the caltrop to then partially dislodge while remaining in the tire, rather than wedging or plugging the penetration hole and preventing air from rapidly escaping the tire.

The penetration tips 122, 124, 126 & 128 have edges 182, 184, 186 & 188 respectively. It is presently preferred to have the caltrop 100 rest on the edges rather than the penetration tip points when the caltrop is deployed on the ground or any generally planar surface. It is presently preferred to constructed the invention of ⅛ inch steel as discussed below, and to sharpen the penetration tips 122, 124, 126 & 128 along edges 182, 184, 186 & 188 to provide for easier tire penetration.

The caltrop 100 can have holes through its structure to provide a means for stringing together multiple caltrops. It is preferred to place two holes 192 & 198 through the two planar portions 132 & 138. Wire can be passed through holes 192 or 198 and through other caltrops to provide a more effective disabling device. After one of the connected caltrops has embedded in a tire, continued motion of the vehicle causes the wire to tug the other connected caltrops which become further entangled with the vehicle. Providing two holes through the interior of the planar portions, rather than one hole through the middle of the caltrop, not only significantly improves the structural strength of the caltrop, it also allows two wires to be used when stringing the caltrops to increase the strength of the connection.

Presently Preferred Method for Constructing the Presently Preferred Embodiment (FIGS. 3–8)

The present invention can be practiced using various construction methods. It is presently preferred to construct the improved caltrop from two ⅛ inch steel plates. It is presently preferred to select a rectangular plate and by cutting away portions and bending appropriately, form one half of the caltrop which can then be welded to an identical member to from the caltrop. FIGS. 3–8 show the presently preferred method of construction.

Figure 3:
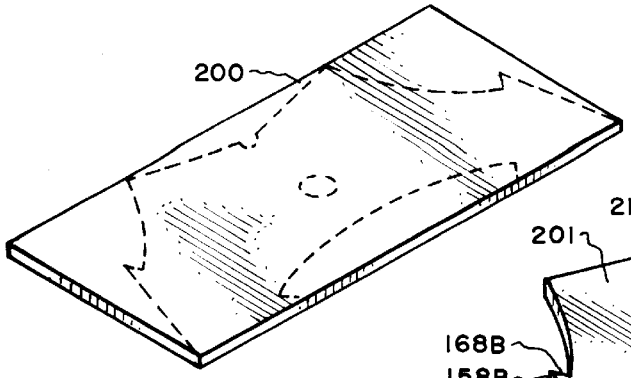
FIG. 3 is an isometric view showing how a rectangular plate is cut in preparation for forming one of two attachable members used to form the presently preferred embodiment of the invention.
Figure 4:
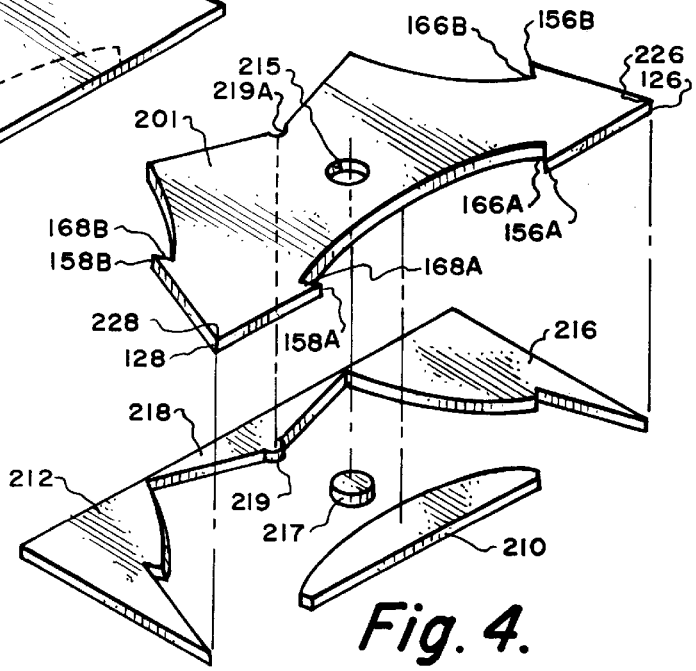
FIG. 4 is an isometric view of the plate of FIG. 3 after being cut.

Turning to FIG. 3, it is presently preferred to select a rectangular plate 200. From one of the longer sides of the rectangular sheet 200, an arcuate partial-pie-section 210 is cut out as shown in FIG. 4. The radius of the arc is along the perpendicular bisector of that longer side and the end points of the arc are recessed from that longer side of the rectangular portion 200. The cut-out section form barbs 156A & 158A with barb shoulders 166A & 168A.

Next, two portions 212 & 216 are each cut from the shorter sides of the rectangular portion 200. The portions 212 & 216 are shaped so as to form penetration points 126 & 128, having internal angles 226 & 228 of approximately 70 degrees and barbs 156B & 158B having barb shoulders 166B & 168B. The barb shoulders 166A and 166B are substantially perpendicular to the bisector of internal angle 226 or axis of penetration of penetration tip 126. Likewise, barb shoulders 168A and 168B are substantially perpendicular to the bisector of internal angle 228 or axis of penetration of penetration tip 128. Additionally, the two portions 212 & 216 are shaped so that segments of arcuate cut-outs are formed symmetrical about the axis of penetration with the one formed by arcuate partial-pie-section cut-out 210.

An obtuse generally isosceles triangular shaped portion 218 is then cut from the side opposite the cut-out left by arcuate partial-pie-section 210. The apex of the cut-out formed by obtuse isosceles triangular portion 218 is located approximately at the intersection of the bisectors of internal angles 226 & 228 and defines an angle of approximately 140 degrees. A small radial section 219 is also removed from the remaining plate to to leave a radial cut-out 219A. Radial cut-out 219A facilitates bending of plate 201 and also facilitates joining the bent plate or member to an identical member to form the caltrop. In addition, radial cut-out 219A is formed so that it facilitates welding and allows the weld to pass through the center of the caltrop thereby significantly strengthening the caltrop. The radial cut-out 219A cannot be so large as to prevent an effective weld. In FIG. 4 the radial section 219 is shown as part of the generally isosceles triangular shaped portion 218.

A section 217 is removed to create hole 215 which is used for stringing together multiple caltrops.

Figure 5:
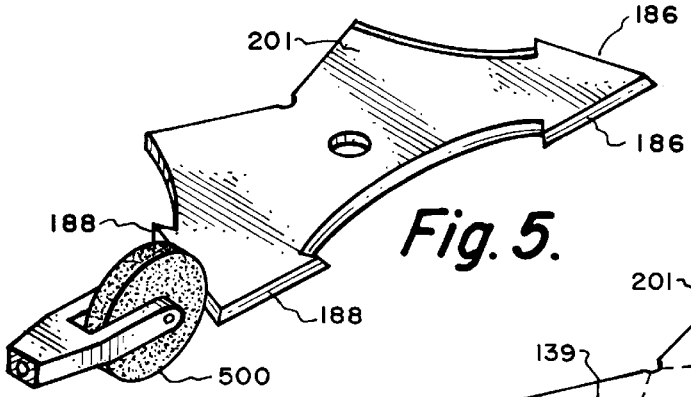
FIG. 5 is an isometric view showing how the plate of FIG. 4 may be sharpened along the edges of the tips.

FIG. 5 shows a grinding device 500 that can be used to sharpen penetration tip edges 186 & 188. As is obvious to one skilled in the art, the edges 186 & 188 could also be sharpened by chisel cutting or by coining. Although it is presently preferred that the sharpened be done by coining prior to folding and assembly of the members, sharpening could also be done after folding or assembly.

Figure 6:
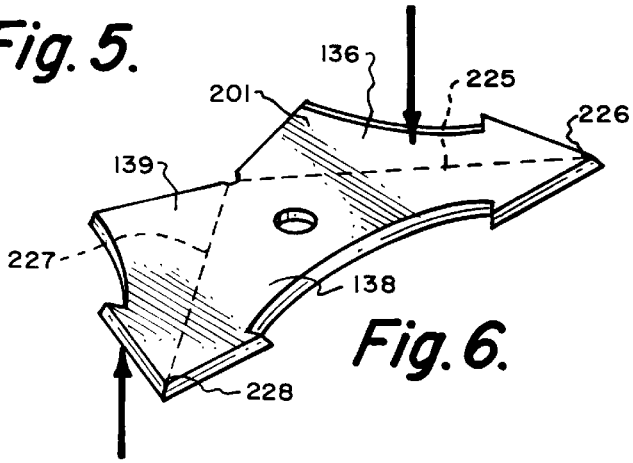
FIG. 6 is an isometric view showing how the plate of FIG. 4 is folded to form one of the two attachable members used to form the presently preferred embodiment of the invention.

FIGS. 6 shows how the remaining plate 201 is folded along the bisectors 225 & 227 of the internal angles 226 & 228 to form the generally isosceles triangular shaped portion 138 and generally right triangular portions 136 & 139.

Figure 7:
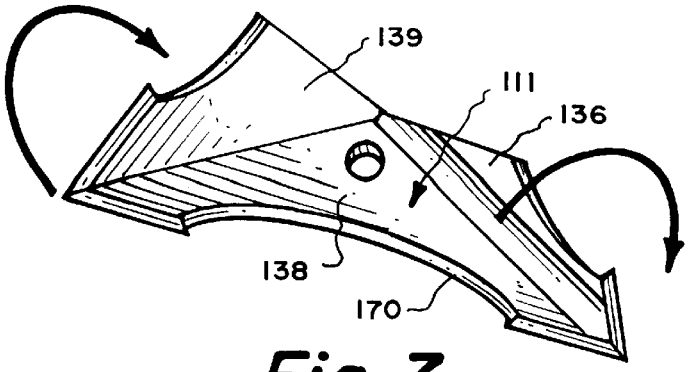
FIG. 7 is an isometric view of one of the two attachable members after it has been folded.

FIG. 7 depicts the folded member or attachable rigid member 111. It also shows how the generally isosceles triangular shaped portion 138 and generally right triangular portions 136 & 139 form rigid member 111. Right triangular portion 136 is shown bent approximately 60 degree to approximately form a 120 degree angle with the isosceles shaped portion 138. Right triangular portion 139 is bent approximately 60 degrees with respect to the opposite side of the isosceles shaped portion 138 to approximately form a 120 degree angle with it. As shown in FIG. 6, portion 136 is bent down while portion 139 is bent up.

Figure 8:
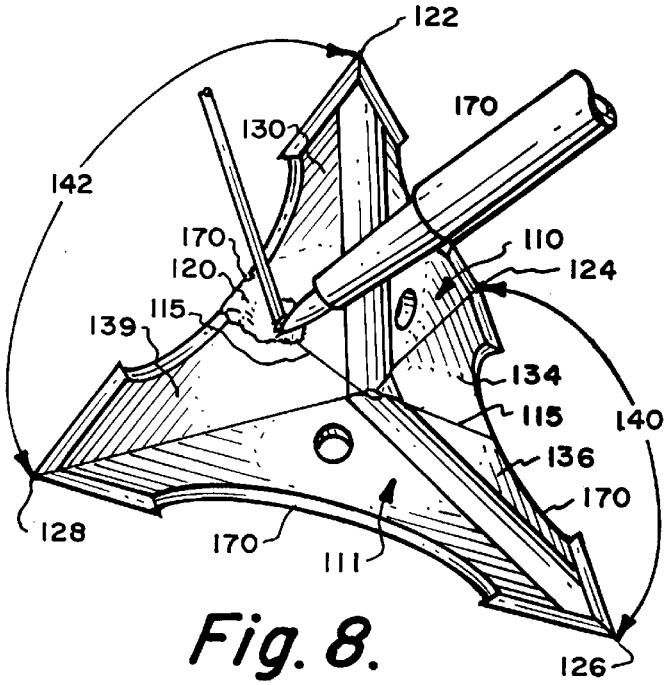
FIG. 8 shows two attachable members being joined by welding to form the presently preferred embodiment of the invention.

FIG. 8 depicts attachable rigid members 110 and 111 being attached by welding along seam 115 formed at the junction of the rigid members 110 and 111. As can be clearly seen in FIG. 7, the two generally right triangular portions 130 & 139 are welded together to form the generally isosceles triangular shaped portion 142. Similarly, generally right triangular portions 130 & 139 form generally isosceles triangular shaped portion 140.

Additionally, it can be seen that penetration tips 122 & 124 are integrally formed to rigid member 110 as are 126 & 128 to rigid member 111. This can also be seen in FIG. 9. This design provides strength to the penetration tips and eliminates the seam along the folds thereby providing a caltrop with improved resistance to folding like a "taco" along the folds. Although it is not necessary to have the seam 115 and weld 120 bisect the radial angles formed by now adjacent penetration tips 122 & 128 and now adjacent penetration tips 124 & 126, it is preferred to have seam 115 and weld 120 approximately bisect them. This causes a force applied normal to the penetration tip, by a tire for example, to cause a shearing force to be distributed along the seam 115 thereby providing added strength to the caltrop. It also increases soundness when forces other than normal to the penetration tip are applied to the caltrop.

FIGS. 9–11

Figure 9:
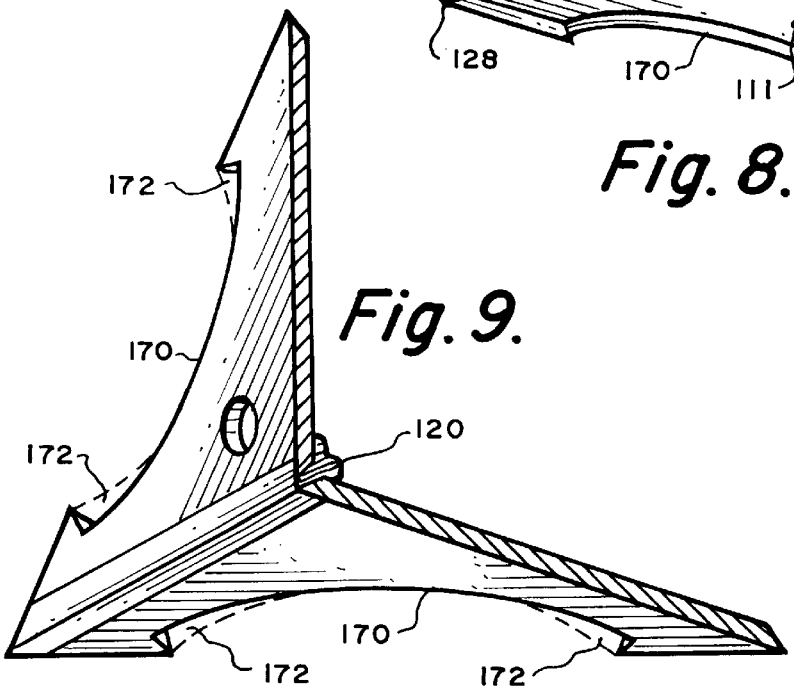
FIG. 9 is a cross-section at 9—9 of FIG. 2.

FIG. 9 is a cross-section at 9—9 of FIG. 2. It shows the weld 120 passing through the center of the structure but not passing along any fold. It also shows the air escape outlets 172 formed by the arcuate partial-pie-section cut-outs 170.

Figure 10:
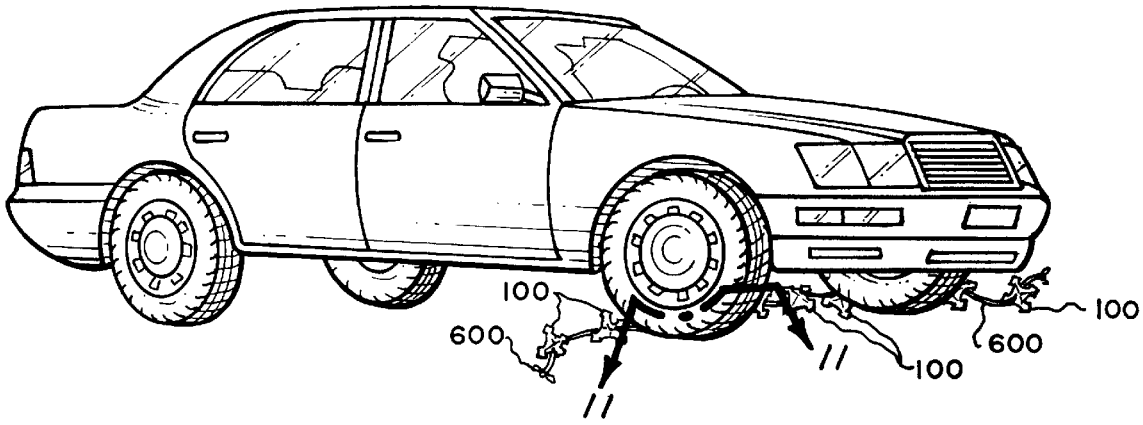
FIG. 10 a depicts vehicle tires encountering a deployment of multiple caltrops strung together.

FIG. 10 depicts multiple caltrops deployed strung together with wire 600 puncturing a vehicle tire.

Figure 11:
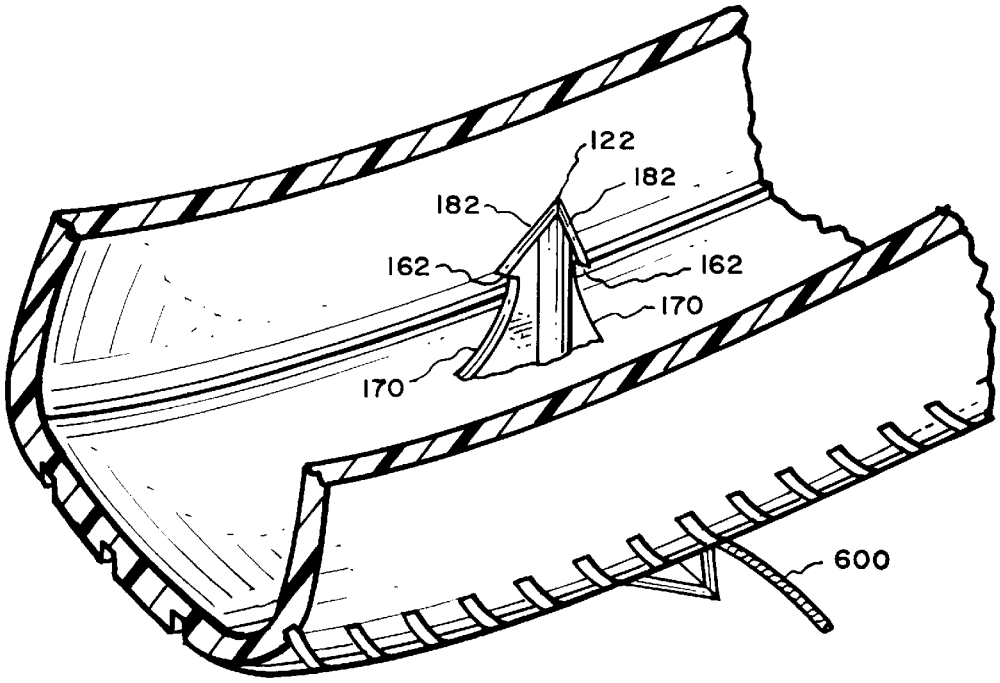
FIG. 11 is a cross-section at 11—11 of FIG. 10.

FIG. 11 is a cross-section at 11—11 of FIG. 10. It depicts a caltrop penetrating a tire. The arcuate cut-outs will 170 allow the caltrop to slide part way of the tire when tugged by wire 600. Barb shoulders 162 will catch on the inner wall of the tire to prevent the caltrop from pulling all the way out of the tire when tugged by wire 600.

Although the presently preferred embodiment of the invention is particularly suited for rapid pneumatic tire deflation, the improved caltrop of this invention is also suited for military anti-personnel use. The caltrop thus described and hereinafter claimed is not only effective at impeding pneumatic tired vehicles and horses but also foot soldiers and other ground traveling vehicles. Its features make it an effective device for these purposes as well.

In addition, although the presently preferred embodiment is suited for use by the military, it is in no way limited to this application and is envisioned as an effect tool for civil authorities as well.

While only the preferred embodiment of the invention has been described, other embodiments could be made without deviating from the invention thus described and in the following claims.

What we claim is:

1. A caltrop comprising:

a) two attachable rigid members, each of the members being comprised of:

(i) a first planar portion of generally isosceles triangular shape;

(ii) a second and a third planar portion being of generally right triangular shape such that the hypotenuse of each of the second and third portions is of equal length to that of the equal sides of the first portion; and (iii) the second and third portions being attached to the first so that the hypotenuse of the second and the third portion each abut one of the equal length sides of the first portion;

b) each of the members having two integrally formed penetration tips; and c) the members being attached together to form the caltrop so that a continuous seam is formed between them, the members being shaped such that the continuous seam is located so as to approximately bisect the radial angles formed between the now adjacent tips, thereby forming the caltrop, the members being attached so that the structure of the caltrop thereby formed comprises four planar portions of generally isosceles triangular shape, the corners opposite equal sides of the isosceles planar portions combining with adjacent corners to form the penetration tips, the penetration tips thereby formed being generally V-shaped along the axis formed by the abutting isosceles planar portions.

2. The caltrop of claim 1 wherein each of the penetration tips further comprises two barbs defined by arcuate partial-pie-section cut-outs in each of the four isosceles portions.

3. The caltrop of claim 1 wherein the planar portions have air escape outlets defined by cut-outs in the planar portions such that the air escape outlets provide an outlet for air after the tips have penetrated and extended through the wall of a pneumatic tire.

4. The caltrop of claim 1 wherein the caltrop further comprises a threading hole for stringing together multiple caltrops.

5. A rigid caltrop structure having four identical planar portions each of a generally isoscelese triangular configuration, each short side of each planar portion coinciding with a short side of another planar portion, the apices of all the short sides of the planar portions being joined in the center of the structure and the pairs of adjacent corners of the short sides forming penetration points, the structure being characterized in that it is formed of two metallic members each of which includes all of a single triangular planar portion and parts of two other adjoining planar portions, and the edges of the two metallic members abutting each other and being welded together to form a continuous seam between them, so that when three of the penetration points rest on a horizontal surface and the fourth penetration point projects upward a force applied to that fourth penetration point will not directly tend to shear the weld.

6. A structure as in claim 5 wherein the two metallic members are identical, and each includes half of each of the two adjoining planar portions of the structure.

7. A structure as in claim 6 wherein the long side of each planar portion of the structure is cut away along an arcuate path that is also recessed with respect to the long side of the triangle, so that each penetration point upon penetrating a vehicle tire will readily cause air to flow out of the tire when the penetration is deep enough that pair of arcuate surfaces enter the tire.

8. A caltrop comprising:

a) two integrally formed members;

b) each of the members having two tips; and c) the members being coupled so that the caltrop is formed of four equally sized planar portions each having three corners and two equal length sides such that each planar portion is of generally isosceles triangular shape, the four planar portions being attached together so that one of the equal length sides of each planar portion abuts and is secured to one of the equal length sides of another of the other four planar portions, the four tips being formed by the adjacent corners located opposite the equal length sides of each planar portion.

9. The caltrop of claim 8 further comprising at least one air escape outlet formed in the planar portions.

10. The caltrop of claim 9 wherein air escape outlets are defined by an arcuate partial-pie-section cut-out in the non-equal length side of each of the planar portions so that two air escape outlets are provided adjacent each tip.

11. The caltrop of claim 8 further comprising barbed tips defined by an arcuate partial-pie-section cut-out in the non-equal length side of each of the planar portions.

12. The caltrop of claim 8 wherein the caltrop further comprises at least one threading hole through at least one of the planar portions, the threading hole being adapted to allow for stringing together of multiple caltrops.

13. The caltrop of claim 8 wherein the two members being of steel and attached by a continuous weld.

14. A caltrop comprising:

a) a rigid structure comprising:

(i) four rigid planar portions each having three corners with two equal length sides and one base side such that each planar portion is of generally isosceles triangular shape;

(ii) the four planar portions being attached so that one of the equal length sides of each planar portion abuts one of the equal length sides of another of the other four planar portions such that each of the equal length sides of all of the four planar portions abuts another portion; and (iii) each of the corners opposite the equal length sides of each planar portion being combined with an adjacent planar portion corner to form a tip, thereby providing four tips; and b) each of the tips having barbs defined by an arcuate cut-outs in the base of each of the planar portions, the end points of the arc being recessed from the base of the planar portion and the radius of the arc being external to the structure.

15. The caltrop of claim 14 wherein the recessed arcuate cut-outs define barb shoulders substantially perpendicular to the axis of penetration of the tip.

16. The caltrop of claim 14 further comprising a threading hole through one of the planar portions, the hole being adapted to allow for stringing together of multiple caltrops.

17. The caltrop of claim 14 wherein the planar portions are of steel.

18. A caltrop comprising:

a) a rigid structure comprising:

(i) four identical planar portions each of a generally isosceles triangular configuration;

(ii) each short side of each planar portion coinciding with a short side of another planar portion; and (iii) the apices of all the short sides of the planar portions being joined in the center of the structure;

b) the pairs of adjacent corners of the short sides forming penetration points;

c) the structure being formed of two metallic members each of which comprises the entirety of a single triangular planar portion but only part of two other adjoining planar portions; and d) the edges of the two metallic members abutting each other and being welded together so that when any three of the penetration points rest on a horizontal surface and the fourth penetration point projects upward, a force applied normal to the upward projecting point will not directly cause a shearing force along the weld.

19. The caltrop of claim 18 wherein the two metallic members are identical and each includes half of each of the two adjoining planar portions of the structure.

20. The caltrop of claim 18 wherein the long side of each planar portion of the structure is cut away along an arcuate path that is recessed with respect to the long side of the triangle so that each penetration point upon penetrating a vehicle tire will readily cause air to flow out of the tire when the penetration is deep enough that the pair of arcuate surfaces enter the tire.

* * * * *